United States Patent [19]

Fromm

[11] 4,398,572

[45] Aug. 16, 1983

[54] HOOPER MECHANISM FOR CONNECTING STEEL BANDS

[75] Inventor: Peter Fromm, Uitikon, Switzerland

[73] Assignee: Fromm AG, Spreitenbach, Switzerland

[21] Appl. No.: 289,178

[22] Filed: Aug. 3, 1981

[30] Foreign Application Priority Data

Aug. 8, 1980 [CH] Switzerland ..... 6032/80

[51] Int. Cl.[3] ..... B21F 9/02

[52] U.S. Cl. ..... 140/93.2

[58] Field of Search ..... 140/93 R, 93.2, 123.6; 29/432, 521, 21.1, 243.5, 243.53

[56] References Cited

U.S. PATENT DOCUMENTS 2,087,655 7/1937 Prestwich ..... 140/93.2

3,083,742 4/1963 Orme ..... 140/93.2

*Primary Examiner*—Francis S. Husar

*Assistant Examiner*—Linda McLaughlin

*Attorney, Agent, or Firm*—Toren, McGeady and Stanger

[57] ABSTRACT

A hooper device for joining together a pair of overlapping steel bands includes a band tensioning device for stretching the bands with a punching and stamping tool including a lower tool section arranged on a base plate of the device toward which an upper tool section is moved. The upper tool section is arranged in a tool support which is structured in the form of a rocker and the tool support is connected by means of a reset device with a driving mechanism. The driving mechanism includes a manual lever having a driving cam with a radial cam which acts upon a pressure roller arranged at the tool support. The rocker construction of the tool support provides a simple, weight saving, operationally safe arrangement for the hooper device.

11 Claims, 5 Drawing Figures

86
42
92
12
8
10
80
82
84
4
90
40
32
20
30
19
14
6
58
60
56
18
66
III
III
64
62
34
16
38
46
44
48
50
36
28
2
26
24
45
22

HOOPER MECHANISM FOR CONNECTING STEEL BANDS

The present invention relates generally to a hooper device for joining together a pair of overlapping steel bands.

Hooper devices of the type to which the present invention relates are known, for example, from German Pat. No. 943,512. In a known hopper device of this type, there is included a band tensioning device with which a steel band placed around an object may be stretched. A punching and stamping tool serves to connect overlapping steel band sections. The punching and stamping tool has an upper tool section which may be moved toward a lower tool section by means of a radial cam which is connected with a driving mechanism, with the lower tool section being arranged on a base plate of the apparatus.

Prior art devices of this type involve disadvantages in that the two steel band sections cannot be punched and connected in a single work step. Usually, the lower steel band section must first be punched and stamped and the upper steel band section can only be punched and connected with the lower steel band section in a second work or operational step.

The upper tool section of the apparatus is guided in a straight of linear guiding devices. A danger arises here in that the tool support twists in the guiding device if the tool support and the guiding device are not of a sufficient length. This necessity further increases the difficulty of the connecting process.

It is also required that a relatively long guiding mechanism be provided which, on the one hand, is rather complicated to manufacture and which, on the other hand, requires relatively substantial structural height.

These requirements lead to mechanisms which are expensive and unduly heavy.

Additionally, in hooper devices of the type previously described, there is provided an ejection mechanism for the steel band sections which have been connected together. If the steel band has a limited band tension, then such an ejection mechanism will at times not be effective because the initial tension of a spring means of the ejection mechanism will not be sufficient to eject the connected steel band sections out of the lower tool section.

Accordingly, the present invention is directed toward provision of a hooper device of the type described which will exhibit significant advantages over devices of the prior art.

SUMMARY OF THE INVENTION

Briefly, the present invention may be described as hooper apparatus for joining together a pair of steel bands comprising: band tensioning means for engaging a pair of overlapping steel bands inserted into the apparatus to hold the bands in a joiner position; and punching and stamping tool means for connecting said overlapping steel bands together, said punching and stamping tool means comprising an upper tool section and a lower tool section adapted to receive said steel bands therebetween, a driving mechanism including a radial cam for moving said upper tool section relative to said lower tool section, a base plate having said lower tool section arranged thereon, and a tool support having said upper tool section attached thereto, said tool support being constructed as a rocker mechanism.

Since, in accordance with the present invention, the upper tool section is attached to a support which is constructed as a rocker mechanism, the tool sections do not engage immediately over their entire length, but rather operate to engage in stages. Thus, an improved connection of the steel band portions can be achieved in a single work step with a reduced power requirement. Additionally, long and complicated guiding mechanisms in the housing and for the tool supports are not necessary.

The tool support may be of a relatively low structural height and must be connected with the frame of the hooper device only by means of a single hinge connection which is simple to manufacture. This simplifies the manufacturing considerably and leads to significant reduction in the structural height of the apparatus and consequently to a less expensive and lighter device.

Twisting of the tool sections is completely eliminated and this leads, on the one hand, to a reduction in power requirements and, on the other hand, to reduced contamination and corrosion in the hooper device.

Furthermore, with the present invention, it is possible to couple the upper tool support with the driving mechanism in a relatively simple manner so that the tool support can be reset by means of the driving mechanism. This also gives rise to an advantage in that an ejection device can be provided which may be directly or indirectly coupled with the driving mechanism.

In a more specific advantageous aspect of the invention, the tool support is mounted on the base plate for pivoted movement about an axis which lies at least approximately in an active plane defined by the punching and stamping tool means along which the steel bands are movable.

The tool support of the upper tool section may be mounted at any selected region of the frame of the hooper device, but mounting at such an active plane is especially desirable because advantageous coordination of the tool support of the upper tool section with the base plate and consequently with the lower tool section may be achieved. This leads to further simplification of the tool support and increases the accuracy of the guidance of the tool support because inaccuracies which may be caused by further rigging of the frame of the hopper device will be eliminated.

The tool support of the upper tool section can interact directly with the radial cam. However, in a further specific embodiment of the invention, especially advantageous features will arise since such an embodiment makes it possible to transfer the driving force of the driving mechanism to the tool carrier with economical power consumption and low friction. In such an embodiment, the tool support is formed with a fastening part for the upper tool section, which fastening part has a bifurcated upper portion in which a shaft mounted pressure roller is supported which interacts with the radial cam of the driving mechanism.

The radical cam of the driving mechanism may be of any construction. However, it is advantageous if the radial cam of the driving mechanism is arranged at a driving cam which is connected with a manually or motor-activated driving element.

The tool support of the upper tool section may be spring biased by means of a return spring to be urged back to its starting position. In accordance with a further advantageous embodiment of the invention, a reset device may be provided which is coupled with the driving mechanism, the reset device serving to return the tool support to the starting position, preferably during reverse movement of the driving mechanism. In this case, it is not necessary to overcome spring action of a return spring when activating the hooper device. On the other hand, it is also ensured that by means of the reset device, a secure return of the tool support into the starting position will always be guaranteed. An especially advantageous embodiment of the reset device involves a reset device which has at least one coupling element which is connected at one end in an articulated manner with the tool support and at the other end is arranged by means of an opening above a return cam and engages at this return cam by means of a projection, wherein the return cam is connected rigidly for rotation with the driving cam.

In such an embodiment, a particularly simple arrangement of the reset device may be provided by hinging the coupling element at the shaft of the pressure roller.

The hooper device of the present invention may be provided with an ejection mechanism which is activated by a spring. However, in a preferred ejection mechanism, an ejection device which is coupled with the driving mechanism is provided, the ejection device having an ejection element which engages from below through an opening into the lower tool section. Here, the ejection mechanism may be coupled either directly or indirectly with the driving mechanism.

In a simpler embodiment of the invention, the ejection mechanism may be connected with the tool support of the upper tool section by arranging the ejection element at an ejection support which is guided in a recess of the base plate and coupled with the tool carrier. A particularly space-saving arrangement will result if the ejection support is hinged to a bolt which is arranged at the rear side of the tool support. The return of the ejection mechanism can be improved by providing a spring which biases the ejection support toward the ejection position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
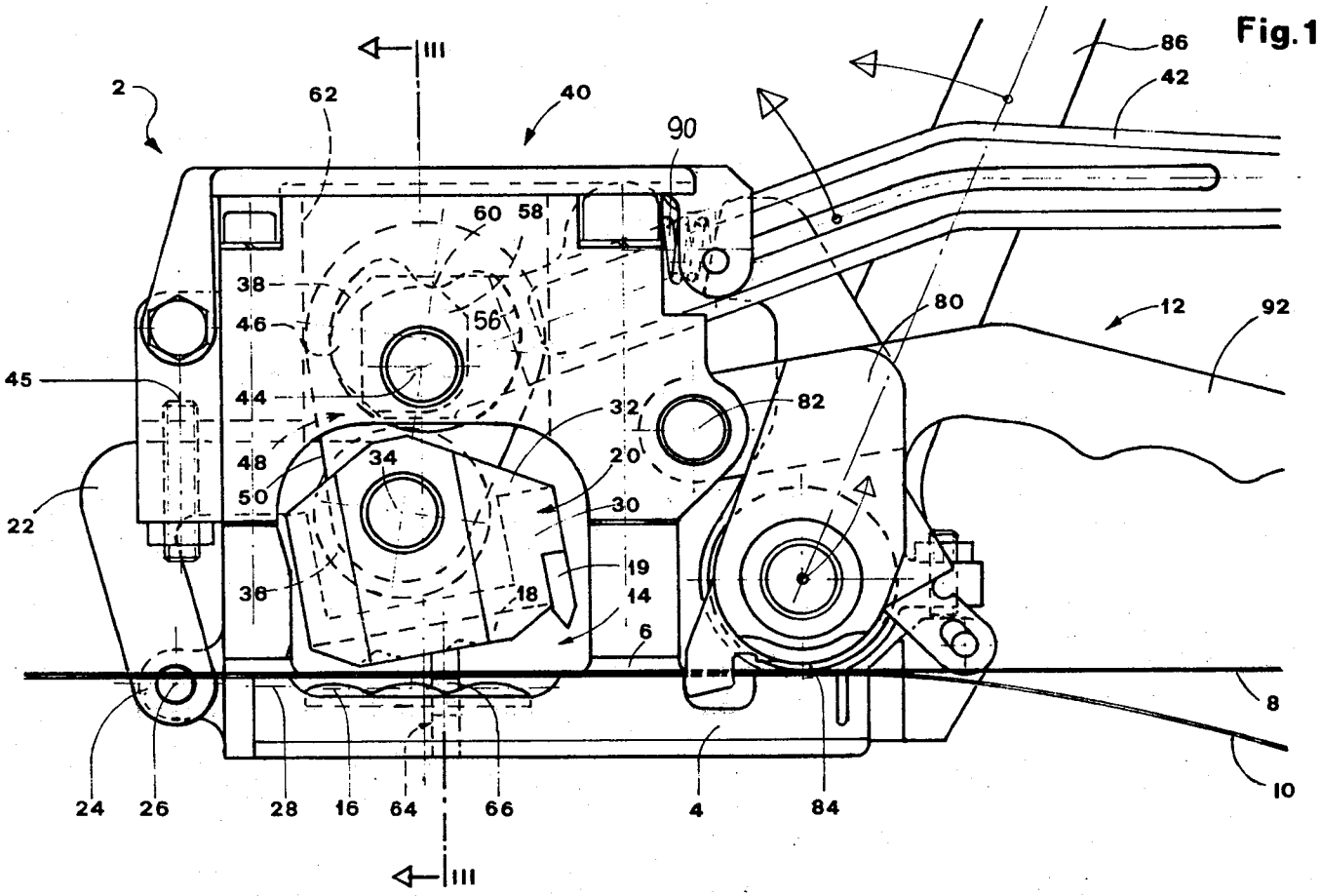
FIG. 1 is a schematic front view of a hooper device in accordance with the present invention showing the punching and stamping tool thereof in the receiving position.

Referring now to the drawings, wherein like reference numerals are used to identify similar parts throughout the various figures thereof, there is shown a hopper apparatus in accordance with the present invention which is basically comprised of a frame 2 with a base plate 4 and with means defining a receiving slot 6 which provides an opening at the side of the apparatus for insertion of steel band sections 8 and 10. A band tensioning device 12 is provided for stressing of the inserted steel band sections. The overlapped and stretched steel band sections 8 and 10 are connected with each other by means of a punching and stamping tool 14 which operates to form in the band sections a punched and stamped joint.

The punching and stamping tool 14 is formed with a lower tool section 16 which is arranged on the base plate 4. The punching and stamping tool 14 also includes an upper tool section 18 having a knife 19 which is arranged on a tool support 20 constructed as a rocker mechanism. The tool support 20 has a bent arm 22 with which it is pivotally supported at a bearing 24 arranged on the base plate 4. The bearing 24 defines a pivotal axis 26 which lies at least approximately in an active plane 28 of the punching and stamping tool.

The tool support 20 includes a fastening part 30 for the upper tool section 18 which contains a fork-like upper portion 32 in which a pressure roller 36 is supported on a shaft 34 for interaction with a cam portion 38 of a driving mechanism 40.

Figure 2:
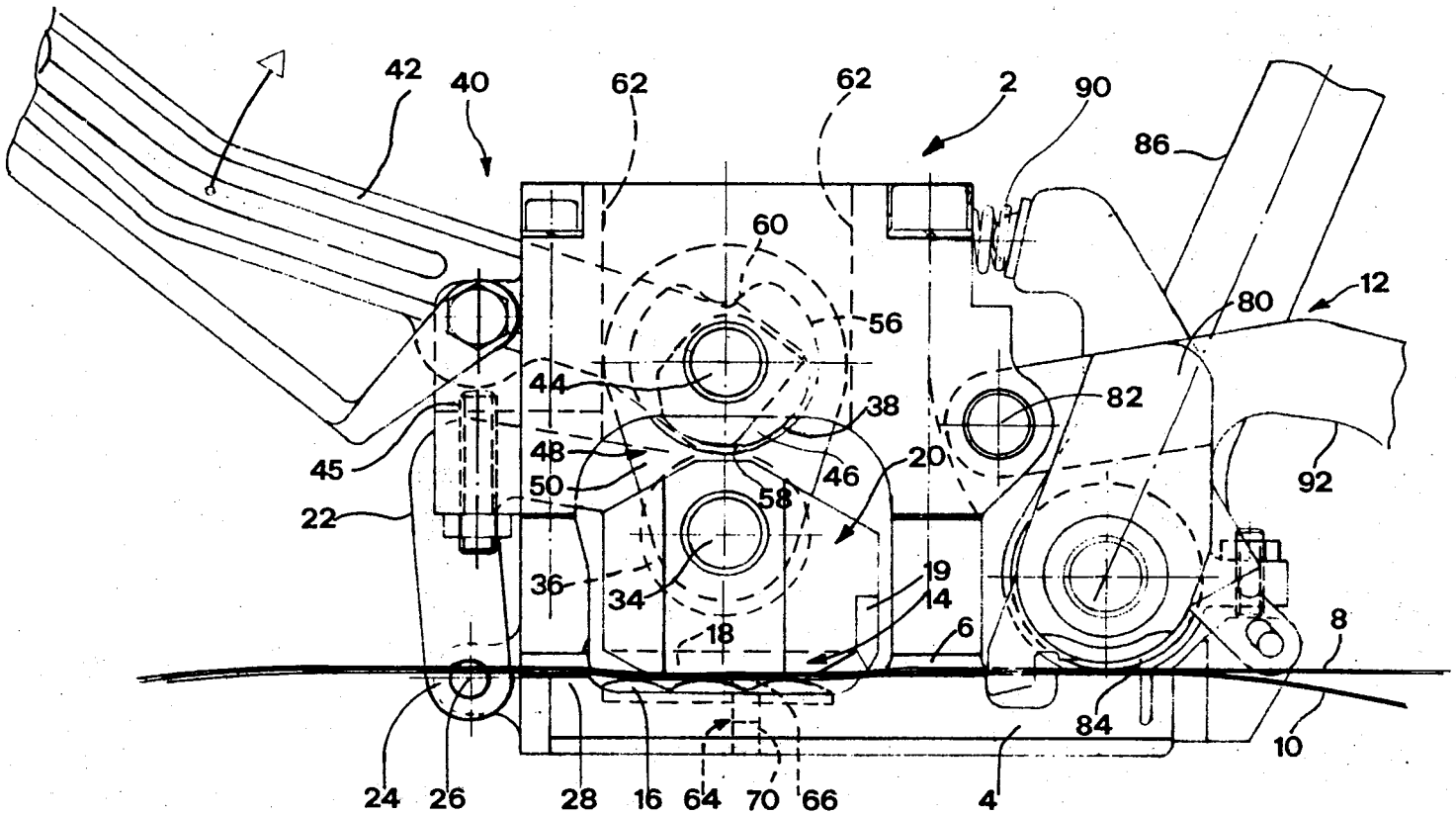
FIG. 2 shows the hooper device depicted in FIG. 1 with the punching and stamping tool in the operating position.
Figure 5:
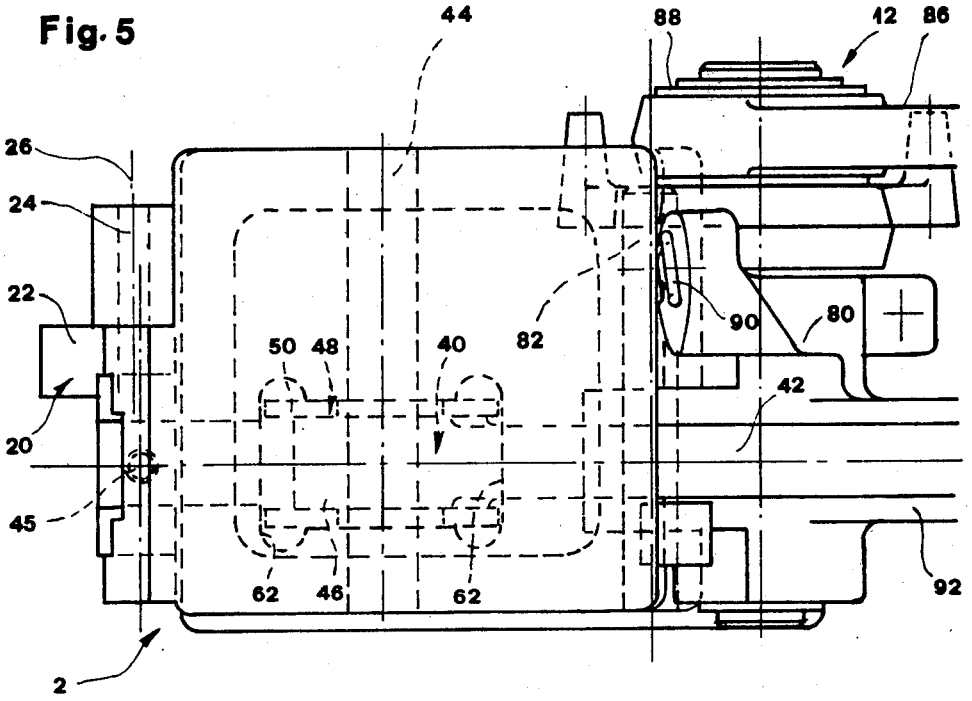
FIG. 5 shows the hooper device of FIG. 1 in plan view.

The driving mechanism 40 in the present invention consists of a manual lever 42 which may be moved or pivoted about a shaft 44 attached in the frame 2, the lever 42 being movable from a receiving position shown in FIG. 1 counter-clockwise until it abuts against an adjustable stop 45 where the lever 42 is placed in the operating position of the apparatus, as shown in FIG. 2.

The manual lever 42 carries a driving cam 46 which contains the cam portion 38. The driving cam 46 interacts with the pressure roller 36. In place of the manual driving mechanism illustrated, it is also possible to provide a mechanism (not shown) utilizing a motor for driving the driving cam.

The hooper device contains a reset mechanism 48 which couples the tool support 20 with the driving mechanism 40. When the manual lever 42 is pivoted back, the tool support is returned to its starting position. The reset device contains two coupling elements 50 which are arranged on both sides of the driving cam 46 and the pressure roller 36. One of the ends of the coupling elements is connected in an articulated manner with the tool support 20.

For this purpose, the pressure roller 36 has recesses 52 at which the coupling elements 50 are attached with a bore 54. The other end of the coupling elements 50 have an opening 56 by means of which each coupling element 50 is arranged over a cam portion 58 which is rigidly connected for rotation with the driving cam 46.

In the opening 56 of each coupling element 50, a projection 60 is arranged which interacts with the cam portion 58. Lateral guides 62 in the frame 2 guide the coupling elements 50.

The arrangement is formulated in such a way that the projection 60 stands at the cam portion 58 of the driving mechanism 40 when the manual lever 42 is in its starting position shown in FIG. 1. When the manual lever 42 is moved into the operating position, then the cam portion 58 releases the projection 60 and the tool support 20 may be lowered without being influenced by the reset device 48.

The hooper apparatus also contains an ejection mechanism 64 which is indirectly connected with the driving mechanism 40. The ejection mechanism 64 includes an ejection element 66 which is arranged on an ejection support 68 which is mounted in a recess 70 in the base plate 4. The ejection element 66 extends through an opening 72 from the bottom through the lower tool section 16 when the tool support 20 is in its starting position.

Figure 3:
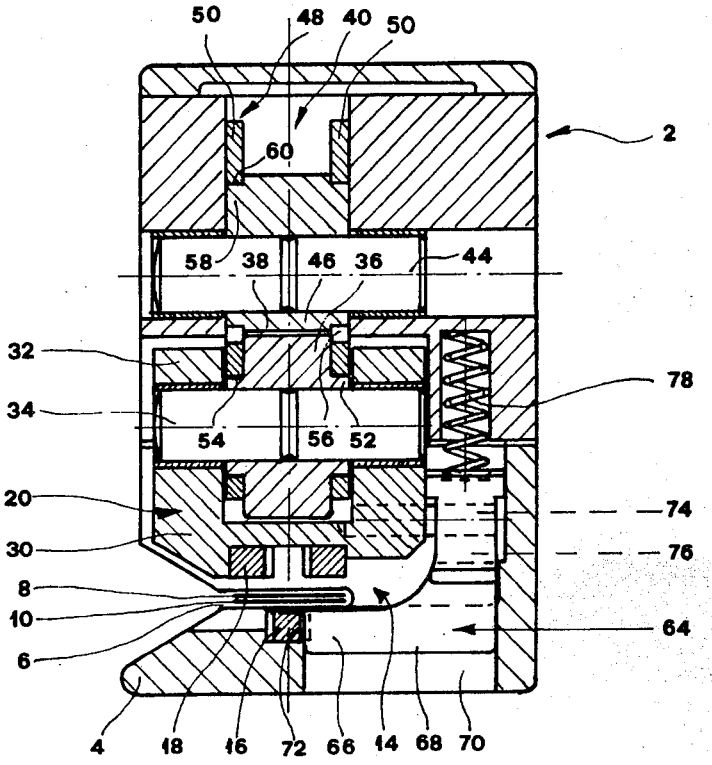
FIG. 3 is a cross-sectional view taken along the line III—III of FIG. 1.
Figure 4:
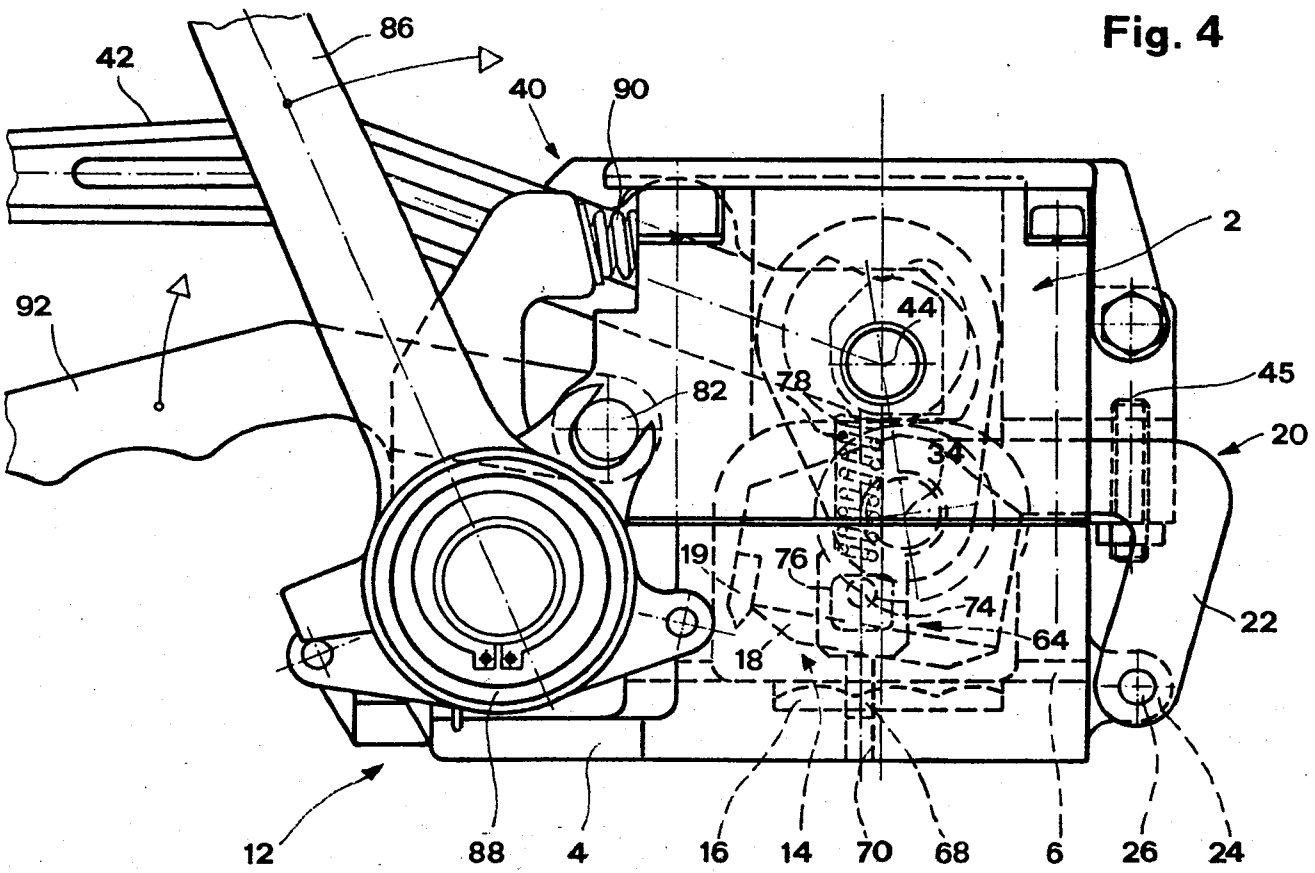
FIG. 4 is a rear view of the hooper device.

The ejection support 68 is coupled at the rear of the tool support 20 with the tool support by means of a bolt 74. The bolt 74 engages in an oblong hole 76 of the ejection support 68. A spring 78 biases the ejection support 68 toward the ejection position (FIG. 3).

The hooper apparatus contains a known band tensioning device 12 which has a bearing block 80 which is attached in an articulated manner by means of a shaft 82 at the frame 2. In the bearing block 80, a tension roller 84 is supported which is activated by means of a clamping lever 86 connected by means of a ratchet arrangement 88. A spring 90 biases the bearing block 80 and consequently the tension roller 84 toward the base plate 4. A handle 92 operates to swivel the bearing block 80 upwardly and thus to lift the tension roller 84 against the force of the spring 90.

In the operation of the apparatus, when it is desired to perform a hooping operation on an object (not shown), a steel band is placed around the object and the steel band sections 8 and 10 are overlapped. While the tension roller 84 is lifted, the steel band sections are then inserted into the receiving slot 6 of the hooper apparatus. By release of the handle 92, the tension roller 84 is pressed against the upper steel band section 8.

The tension roller 84 is activated by means of the clamping lever 86 and the upper steel band section 8 is moved relative to the lower stationary steel band section 10. When the desired tension is reached, the manual lever 42 is then moved from the starting position shown in FIG. 1 to the operating position shown in FIG. 2 and the upper tool section 18 is lowered together with the knife 19.

The adjustable stop 45 determines the depth of penetration of the punching and stamping tool 14 and of the knife 19. As soon as the manual lever 42 abuts against the stop 45, the joint is completed and the upper steel band section 8 is cut off from the end of the band which extends from the supply reel. The manual lever 42 is then swiveled back into the starting position and the tool support 20 is returned to the starting position by the reset device 48.

The tool support 20 simultaneously activates the ejection mechanism 64 whereby the steel band sections 8 and 10 which have been joined are ejected from the lower tool section 16.

The hooper apparatus is subsequently removed while the band tensioning device 12 is loosened from the closed steel band.

While a specific embodiment of the invention has been shown and described in detail to illustrate the application of the inventive principles, it will be understood that the invention may be embodied otherwise without departing from such principles.

What is claimed is:

1. Hooper apparatus for joining a pair of steel bands comprising: band tensioning means for engaging a pair of overlapping steel bands inserted into said apparatus to hold said bands in a joiner position; and punching and stamping tool means for connecting said overlapping steel bands together, said punching and stamping tool means comprising an upper tool section and a lower tool section adapted to receive said steel bands therebetween, a driving mechanism including a cam portion for moving said upper tool section relative to said lower tool section, a base plate having said lower tool section arranged thereon, and a tool support having said upper tool section attached thereto, said tool support being constructed as a rocker mechanism, wherein said tool support is pivotally mounted about an axis which lies perpendicular to the direction of the steel bands and at least approximately in an active plane defined by said punching and stamping tool means.

2. Apparatus according to claim 1 wherein said radical cam of said driving mechanism is arraged at a driving cam which is connected with a driving element.

3. Apparatus according to claim 2 wherein said driving element is manually activated.

4. Apparatus according to claim 1 further comprising a reset device coupled with said driving mechanism, said reset device operating to bring said tool support into a starting position during reverse movement of said driving mechanism.

5. Apparatus according to claim 4 wherein said reset device has at least one coupling element which is connected at one end in an articulated manner with said tool support and at another end is arranged by means of an opening above a return cam and engages at the return cam by means of a projection, said return cam being rigidly connected for rotation with said driving cam.

6. Apparatus according to claim 5 wherein said coupling element is hinged at said shaft of said pressure roller.

7. Hooper apparatus for joining a pair of steel bands comprising: band tensioning means for engaging a pair of overlapping steel bands inserted into said apparatus to hold said bands in a joiner position; and punching and stamping tool means for connecting said overlapping steel bands together, said punching and stamping tool means comprising an upper tool section and a lower tool section adapted to receive said steel bands therebetween, a driving mechanism including a cam portion for moving said upper tool section relative to said lower tool section, a base plate having said lower tool section arranged thereon, and a tool support having said upper tool section attached thereto, said tool support being constructed as a rocker mechanism, wherein said tool support includes a fastening part for said upper tool section and wherein said fastening part has a bifurcated upper portion in which a pressure roller is supported on a shaft, said pressure roller interacting with said cam portion of said driving mechanism.

8. Hooper apparatus for joining a pair of steel bands comprising: band tensioning means for engaging a pair of overlapping steel bands inserted into said apparatus to hold said bands in a joiner position; and punching and stamping tool means for connecting said overlapping steel bands together, said punching and stamping tool means comprising an upper tool section and a lower tool section adapted to receive said steel bands therebetween, a driving mechanism including a cam portion for moving said upper tool section relative to said lower tool section, a base plate having said lower tool section arranged thereon, and a tool support having said upper tool section attached thereto, said tool support being constructed as a rocker mechanism, said apparatus further comprising an ejection mechanism coupled with said driving mechanism, said ejection mechanism having an ejection element which engages from below and opening into said lower tool section.

9. Apparatus according to claim 8 wherein said ejection element is arranged at an ejection support which is guided in a recess of said base plate and is coupled with said tool support.

10. Apparatus according to claim 9 wherein said ejection support is hinged to a bolt arranged at the rear side of said tool support.

11. Apparatus according to claim 9 wherein said ejection support is biased by means of a spring toward an ejection position.

* * * * *